US007564196B2

(12) United States Patent
Shiwaya et al.

(10) Patent No.: US 7,564,196 B2
(45) Date of Patent: Jul. 21, 2009

(54) POWER SUPPLY DEVICE, AND LED DEVICE AND ELECTRONIC DEVICE USING SAME

(75) Inventors: Yohichi Shiwaya, Toyonaka (JP); Toshiki Kishioka, Toyonaka (JP); Koichi Hagino, Kawanishi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/048,968

(22) Filed: Mar. 14, 2008

(65) Prior Publication Data

US 2008/0231209 A1 Sep. 25, 2008

(30) Foreign Application Priority Data

Mar. 19, 2007 (JP) ..... 2007-070932

(51) Int. Cl.
*H05B 37/02* (2006.01)

(52) U.S. Cl. ..... 315/291; 315/209 R; 315/307; 323/234; 323/282

(58) Field of Classification Search ..... 315/209 R, 315/224, 291, 307; 323/234, 281–283; 363/59; 327/148, 157, 536
See application file for complete search history.

(56) References Cited

U.S. PATENT DOCUMENTS 6,822,403 B2 * 11/2004 Horiuchi et al. ..... 315/307
7,304,871 B2 * 12/2007 Ito et al. ..... 363/59
2007/0210774 A1 * 9/2007 Kimura et al. ..... 323/282
2008/0129220 A1 * 6/2008 Shteynberg et al. ..... 315/291

FOREIGN PATENT DOCUMENTS

JP 2005-157631 6/2005
JP 2005-196556 7/2005

* cited by examiner

*Primary Examiner*—David Hung Vu
*Assistant Examiner*—Tung X Le
(74) *Attorney, Agent, or Firm*—Dickstein Shapiro LLP

(57) ABSTRACT

A power supply device includes a step-up circuit configured to supply a driving voltage to a load, a comparison circuit configured to compare an output voltage from the load with a reference voltage, and a control circuit configured to control the step-up circuit based on a comparison result generated by the comparison circuit. The step-up circuit includes multiple operation modes each outputting a given voltage not lower than a power source voltage. The control circuit controls the step-up circuit to operate in one of the multiple operation modes. The control circuit maintains a current operation mode of the step-up circuit until the output voltage from the load decrease to below the reference voltage and, when the output voltage from the load is less than the reference voltage, switches the operation mode to another operation mode to output a voltage higher than a voltage output in the current operation mode.

10 Claims, 2 Drawing Sheets

POWER SUPPLY DEVICE, AND LED DEVICE AND ELECTRONIC DEVICE USING SAME

CROSS-REFERENCE TO RELATED APPLICATIONS

This patent specification claims priority from Japanese Patent Application No. 2007-070932, filed on Mar. 19, 2007 in the Japan Patent Office, the entire contents of which are hereby incorporated by reference herein.

BACKGROUND OF THE INVENTION

1. Field of the Invention

The present invention generally relates to a power supply device, and a light-emitting diode (LED) device and electronic device using the power supply device.

2. Discussion of the Background Art

To supply power to a load, such as a LED, a power supply circuit that includes a constant-current circuit connected to a driving path for the load, and a step-up circuit for driving the load is currently used. To enhance efficiency in power supply by such a power supply circuit, changes in a drive state of the load are monitored and the voltage step-up rate of the step-up circuit is controlled based on results of the monitoring.

In a known method, when voltage from a power source decreases, driving voltage is maintained constant by using the step-up circuit to increase the driving voltage for the load (LED) so as to enhance efficiency in power supply and/or reduce power consumption.

However, the power source voltage may be increased by supplying power, such as by charging, or electrical current of the load may decrease, and accordingly a forward voltage of the load may decrease while the load is driven by the driving voltage increased by the step-up circuit. If the increased driving voltage is continuously applied to the load in this state, the load receives an excessive voltage and efficiency in power supply is reduced.

Therefore, a need has arisen for optimizing the driving voltage for the load by controlling the voltage step-up rate of the step-up circuit so as to correspond to changes in the power source voltage and the drive state of the load.

SUMMARY OF THE INVENTION

In view of the foregoing, in one illustrative embodiment of the present invention a power supply device includes a step-up circuit configured to supply a driving voltage to a load, a comparison circuit configured to compare an output voltage from the load with a reference voltage, and a control circuit configured to control the step-up circuit based on a comparison result generated by the comparison circuit. The step-up circuit includes multiple operation modes each outputting a given voltage not lower than a power source voltage. The control circuit controls the step-up circuit to operate in one of the multiple operation modes. The control circuit maintains a current operation mode of the step-up circuit until the output voltage from the load decreases to below the reference voltage and, when the output voltage from the load is less than the reference voltage, switches the operation mode to another operation mode to output a voltage higher than a voltage output in the current operation mode.

In another illustrative embodiment of the present invention, a LED device employs the power supply device described above in a LED circuit.

In yet another illustrative embodiment of the present invention, an electronic device includes one of the power supply device and the LED device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
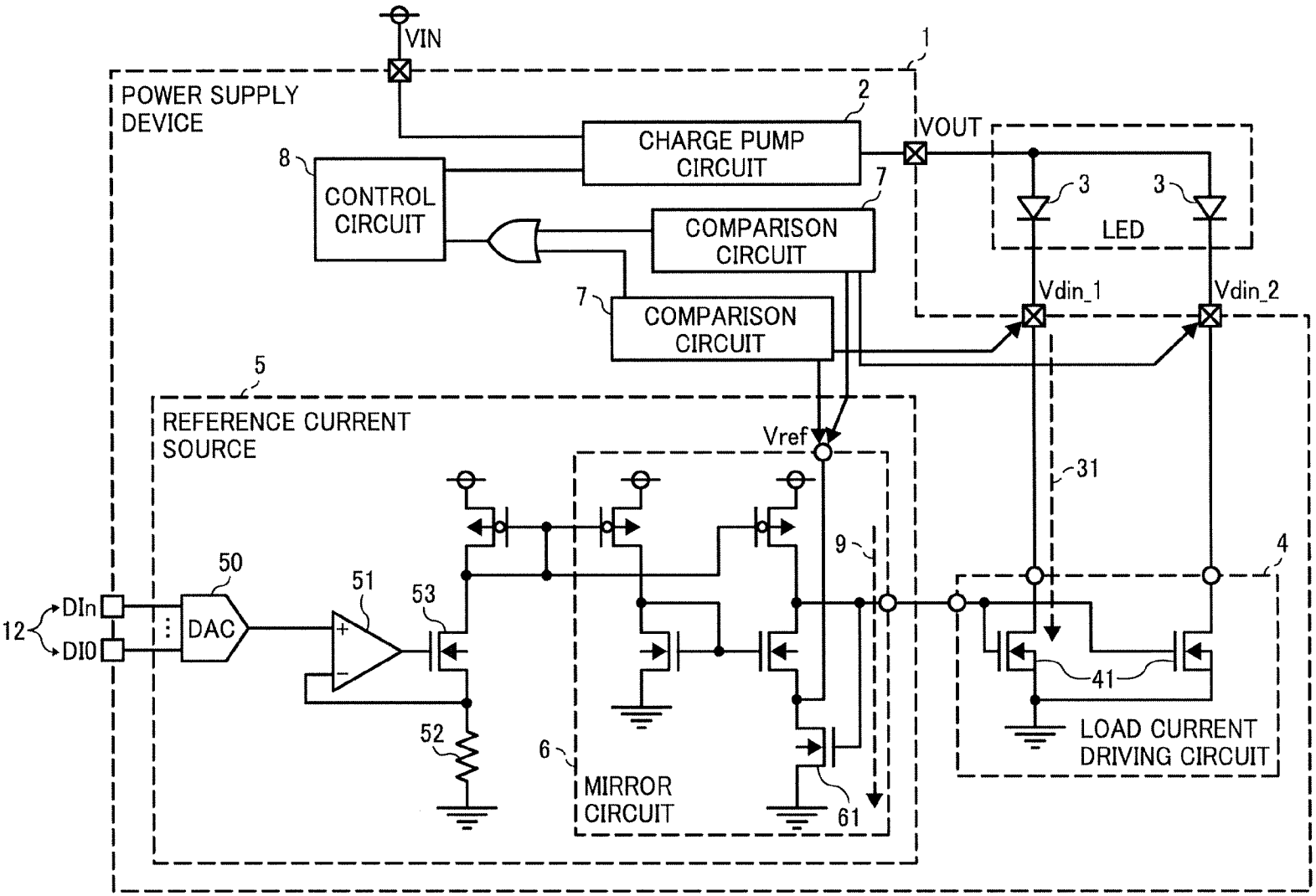
FIG. 1 illustrates an example of a configuration of a power supply device according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a power supply device 1 according to an illustrative embodiment of the present invention is described.

Referring to FIG. 1, the power source device 1 includes a charge pump circuit 2 as a step-up circuit connected to a power source voltage VIN to supply a driving voltage to light-emitting diodes (LEDs) 3 that are loads, a load current driving circuit 4 to pass a load current through the LEDs 3, a reference current source 5, comparison circuits 7, and a control circuit 8.

The reference current source 5 has a function to set a reference value of an electrical current applied to the LEDs 3 according to an external signal 12 regardless of changes in the power source voltage VIN. Further, the reference current source 5 includes an electrical current mirror circuit 6 that has a function to apply an electrical current identical or substantially similar to the reference current value to a reference path 9. The comparison circuits 7 compare output voltage Vdin from each LED 3 with a reference voltage Vref that is generated in the reference path 9 of the mirror circuit 6. The control circuit 8 controls a step-up rate of the charge pump circuit 2 based on comparison results of the comparison circuits 7.

It is to be noted that FIG. 1 illustrates an example in which the LEDs 3 are connected in parallel to an output voltage VOUT from the charge pump circuit 2, and alternatively, the LEDs 3 can be connected in series.

The load current driving circuit 4 includes N-channel MOS (NMOS) field-effect transistors 41 used for the LEDs 3A, respectively.

The reference current source 5 further includes a digital-to-analog converter (DAC) 50, an amplifier 51, and an NMOS field-effect transistor 53. To generate the reference current value, the DAC 50 converts the external signal 12 into a certain voltage and inputs the certain voltage to a positive input terminal of the amplifier 51. The certain voltage is converted into an electrical current. Because a resistance 52 is connected between a negative input terminal of the amplifier 51 and a ground, the reference current value generated by the reference current source 5 is not affected by changes in the power source voltage VIN.

In the reference current source 5, a gate of the NMOS field-effect transistor 53 is connected to an output terminal of the amplifier 51, and a source thereof is short-circuited and connected to the negative input terminal of the amplifier 51 so as to stabilize the reference current value.

The mirror circuit 6 forms an electrical current mirror with the NMOS field-effect transistors 41 of the load current driving circuit 4 and transmits the reference current value to a load path 31 that connects to the LEDs 3. The mirror circuit 6 includes a transistor 61, on the reference path, that forms a current mirror with the transistors 41 of the load current driving circuit 4. The transistor 61 includes a first node connected to a node at which the reference voltage is generated, a second node connected to a fixed voltage, and a control terminal connected to control terminals of the transistors 41.

It is to be noted that the number of the comparison circuits 7 is identical to that of the NMOS field-effect transistors 41. In the example shown in FIG. 1, the number of the comparison circuits 7 is two.

The charge pump circuit 2 includes three operation modes (voltage step-up mode) each of which outputs a predetermined or given voltage not lower than the power source voltage VIN: a first operation mode to output a voltage identical or substantially similar to the power source voltage VIN, a second operation mode to output a voltage higher than the power source voltage VIN, and a third operation mode to output a voltage higher than the voltage output in the second operation mode. For example, in a known method, the voltage output in the second operation mode is increased to one and a half times as high as the power source voltage VIN, and the voltage output in the third operation mode is twice as-high as the power source voltage VIN.

A method to control the step-up rate of the charge pump circuit 2 performed by the control circuit 8 is described below with reference to FIG. 2.

Figure 2:
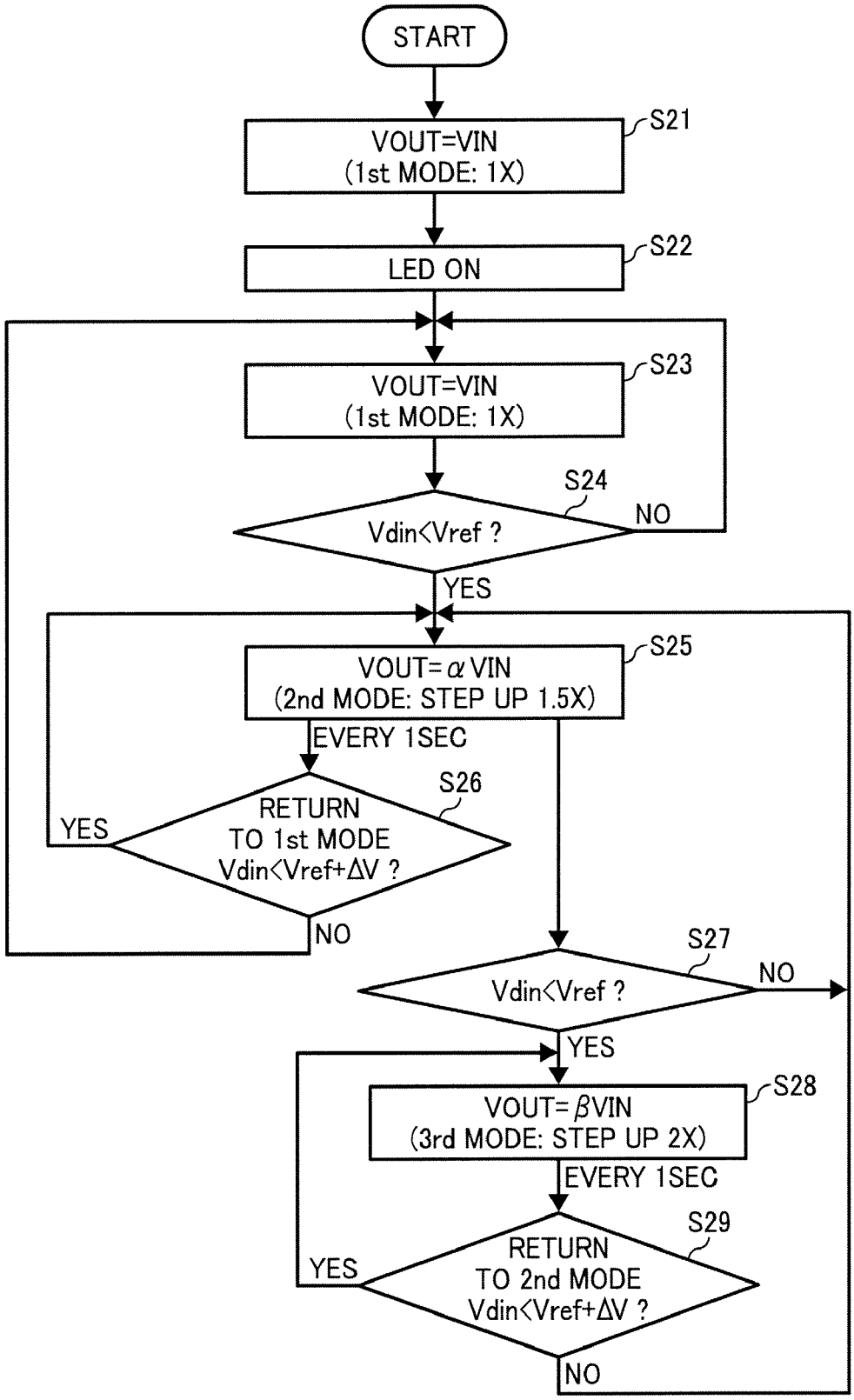
FIG. 2 illustrates a sequence of processes to control voltage step-up rate of a charge pump circuit performed by a control circuit.

FIG. 2 illustrates a sequence of the step-up control of the charge pump circuit 2 performed by the control circuit 8. When power is turned on, the charge pump circuit 2 shown in FIG. 1 starts operating in the first operation mode in which a voltage identical or substantially similar to the power source voltage VIN is output to the output voltage VOUT.

When the output voltage VOUT of the charge pump circuit 2 reaches a value identical or substantially similar to the power source voltage VIN at S21, the load current driving circuit 4 is driven to supply a load current to the LEDs 3, thus turning on the LEDs 3 at S22.

While the charge pump circuit 2 operates in the first operation mode at S23, at S24 the comparison circuits 7 start comparing the output voltage Vdin with the reference voltage Vref when the load current driven circuit 4 is driven as described above. The output voltage Vdin is obtained by deducting a forward voltage of the LED 3 from the output voltage VOUT from the charge pump circuit 2 operating in the first operation mode.

When the output voltage Vdin is larger than the reference voltage Vref (NO at S24), the charge pump circuit 2 maintains the first operation mode. By contrast, when the output voltage Vdin is smaller than the reference voltage Vref (YES at S24), at S25 the charge pump circuit 2 switches the operation mode to the second operation mode and increases the output voltage VOUT to one and a half times as high as the power source voltage.

After the charge pump circuit 2 enters the second operation mode based on the comparison result of the comparison circuits 7 at S25, at S26 the control circuit 8 regularly returns the voltage step-up mode (charge pump circuit operation mode) to the first operation mode. In the example shown in FIG. 2, the control circuit 8 returns the operation mode to the first operation mode every second.

After the charge pump circuit 2 returns to the first operation mode, at S26, the control circuit 8 further determines whether to switch the voltage step-up mode to the second operation mode or maintain the first operation mode based on the result of the comparison of the output voltage Vdin with the reference voltage Vref generated by the comparison circuits 7.

Specifically, when the output voltage Vdin is not smaller than the reference voltage Vref (NO at S26), the charge pump circuit 2 returns to S23 and maintains the first operation mode. By contrast, when the output voltage Vdin is smaller than the reference voltage Vref (YES at S26), the charge pump circuit 2 returns to S25 and switches the operation mode to the second operation mode so as to increase the output voltage VOUT to one and a half times as high as the power source voltage.

It is to be noted that a hysteresis may be added to the reference voltage Vref when the comparison circuits 7 compare the output voltage Vdin with the reference voltage Vref at S26.

By using this characteristic, the effect described below can be obtained.

In the power supply device 1 shown in FIG. 1, a load current that flows when the operation mode of the charge pump circuit 2 is about to or is in transition from the first operation mode to the second operation mode, in which the output voltage Vdin of the LEDs 3 is generated from the power source voltage VIN, may be slightly different from a load current that flows when the charge pump circuit 2 operates in the second operation mode. In such a case, when the operation mode of the charge pump circuit 2 is about to or is in the transition from the first operation mode to the second operation mode, if the power source voltage VIN fluctuates due to noise, etc., the operation of the charge pump circuit 2 alternates between these two operation modes, causing the load current value to fluctuate. In this case, fluctuation in the load current and flickering of the LEDs 3 can be prevented or reduced by immediately changing the operation mode to the second operation mode even if the operation mode is returned to the first operation mode.

Although the LEDs 3 might be turned off due to a shortage of voltage to drive the LEDs 3 when the control circuit 8 returns the voltage step-up mode to the first operation mode, lighting of the LEDs can be stabilized when the control circuit 8 is configured to determine the operation mode of the charge pump circuit 2 based on the comparison result generated by the comparison circuits 7 in a relatively short time period. In the example shown in FIG. 2, for example, the operation mode determination time is 0.1 millisecond.

Further, after the operation mode of the charge pump circuit 2 is changed to the second operation mode at S25, at S27 the comparison circuits 7 compare the output voltage Vdin with the reference voltage Vref. When the output voltage Vdin is not smaller than the reference voltage Vref (NO at S27), the control circuit 8 determines to return to S25 and maintain the second operation mode, similarly to the control method of the first operation mode.

By contrast, when the output voltage Vdin is smaller than the reference voltage Vref (YES at S27), at S28 the control circuit 8 determines to change the operation mode of the charge pump mode 2 to the third operation mode, in which the output voltage is increased to twice as high as the power source voltage VIN.

After the voltage step-up mode is changed to the third operation mode at S28, at S29 the control circuit 8 regularly returns the voltage step-up mode to the second operation mode, similarly to the control method of the second operation mode. In the example shown in FIG. 2, the control circuit 8 returns the operation mode to the first operation mode every second.

Further, at S29 the comparison circuits 7 compare the output voltage Vdin from the LEDs 3 with the reference voltage Vref. When the output voltage Vdin is not smaller than the reference voltage Vref (NO at S29), the control circuit 8 returns to S25 and maintains the second operation mode. By contrast, when the output voltage Vdin is smaller than the reference voltage Vref (YES at S29), the control circuit 8 returns to S28 and switches the voltage step-up mode to the third operation mode so as to increase the output voltage VOUT to twice as high as the power source voltage.

It is to be noted that a hysteresis may be added to the reference voltage Vref when the comparison circuits 7 compare the output voltage Vdin with the reference voltage Vref at S29.

Because the control circuit 8 controls the charge pump circuit 2 as described above, the driving voltage for the LEDs can be optimized with regard to various factors including changes in the power source voltage, the forward voltage of the LEDs, and setting of the load current that flows to the LEDs, thus ensuring reliable driving of the LEDs and effective power supply for the LEDs (load). Further, the power supply device 1 described above can be used as a power supply device for a LED circuit and the power supply device 1 and/or such an LED device including the power supply device 1 can be integrated into an electronic device, enabling reliable driving thereof and efficient power supply therefor.

As can be appreciated by those skilled in the art, although the step-up circuit is the charge pump circuit in the description above, alternatively, the step-up circuit may be a switching regulator circuit. In this case also, the control circuit can control an output voltage of the switching regulator circuit based on the comparison result generated by the comparison circuit so as to keep the output voltage from the load to a voltage not less than the reference voltage.

As described above, in the power supply device according to the present invention, the step-up circuit includes multiple operation modes each of which outputs a given voltage not less than the power source voltage. Further, the control circuit controls the step-up circuit to operate in one of these operation modes. The control circuit maintain a current operation mode until the output voltage from the load decreases to below the reference voltage, and switches the operation mode to another operation mode in which the step-up circuit outputs a voltage higher than the voltage output in the current operation mode.

The reference electrical current flowing through the reference path of the mirror circuit is not affected by changes in the power source voltage, and the load current flowing through the load current path can be kept constant by copying the reference electrical current by a current mirror. The driving voltage for the load can be optimized by comparing the load current with the reference electrical current, thus ensuring reliable driving of the load and effective power supply for the load.

Moreover, fluctuation in the load current can be prevented or reduced by adding a hysteresis to the reference voltage in the comparison between the output voltage from the load and the reference voltage.

More specifically, the power supply device may have a characteristic that a load current value in the first operation mode is slightly different from that in another operation mode. When the power source voltage is around a boundary voltage between the first operation mode and the second operation mode (α operation mode) or between the second operation mode and the third operation mode (β operation mode), the operation mode of the step-up circuit may alternate between these two modes if the power source voltage fluctuates due to noise, etc., thus causing the load current to fluctuate. However, such fluctuation can be prevented or reduced by adding a hysteresis to the reference voltage in the comparison between the output voltage from the load and the reference voltage.

This invention may be conveniently implemented using a conventional general purpose digital computer programmed according to the teachings of the present specification, as will be apparent to those skilled in the computer arts. Appropriate software coding can readily be prepared by skilled programmers based on the teachings of the present disclosure, as will be apparent to those skilled in the software arts. The present invention may also be implemented by the preparation of application specific integrated circuits or by interconnecting an appropriate network of conventional component circuits, as will be readily apparent to those skilled in the relevant art.

Numerous additional modifications and variations are possible in light of the above teachings. It is therefore to be understood that, within the scope of the appended claims, the disclosure of this patent specification may be practiced otherwise than as specifically described herein.

What is claimed is:

1. A power supply device, comprising:

a step-up circuit configured to supply a driving voltage to a load and include multiple operation modes each outputting a given voltage not lower than a power source voltage;

a comparison circuit configured to compare an output voltage from the load with a reference voltage; and a control circuit configured to control the step-up circuit to operate in one of the multiple operation modes based on a comparison result generated by the comparison circuit;

wherein the control circuit maintains a current operation mode of the step-up circuit until the output voltage from the load decreases to below the reference voltage and, when the output voltage from the load is less than the reference voltage, switches the operation mode to another operation mode to output a voltage higher than a voltage output in the current operation mode.

2. The power supply device according to claim 1, wherein the multiple operation modes include a first operation mode that outputs a voltage identical to the power source voltage, the step-up circuit starts operating in the first operation mode when the power source voltage is applied to the power supply device, maintains the first operation mode until the output voltage from the load decreases to below the reference voltage, and switches from the first operation mode to an α operation mode to output a voltage Vα that is a given voltage higher than the voltage output in the first operation mode when the output voltage from the load is less than the reference voltage, and the control circuit regularly returns the operation mode to the first operation mode while the step-up circuit operates in the α operation mode.

3. The power supply device according to claim 2, wherein, when the output voltage from the load decreases to below the reference voltage while the step-up circuit operates in the α operation mode, the step-up circuit switches the operation mode to a β operation mode to output a voltage Vβ that is a given voltage higher than the voltage Vα, and the control circuit regularly returns the operation mode of the step-up circuit to a lower step-up operation mode including the first operation mode and the α operation mode that outputs a voltage lower than the voltage Vβ while the step-up circuit operates in the β operation mode, maintains the lower step-up operation mode when the output voltage from the load is not less than the reference voltage, and switches from the lower step-up operation mode to a higher step-up operational mode including the α operation mode and the β operation mode that outputs the voltage higher than the current voltage when the output voltage from the load is less than the reference voltage.

4. The power supply device according to claim 2, wherein a given voltage is added as hysteresis to the reference value in the comparison between the output voltage from the load and the reference voltage when the operation mode of the step-up circuit is returned to the lower step-up operation mode.

5. The power supply device according to claim 2, wherein the step-up circuit is a charge pump circuit, the voltage Vα output in the α operation mode is a voltage obtained by multiplying the power source voltage with α that is greater than 1, and the voltage Vβ output in the β operation mode is a voltage obtained by multiplying the power source voltage with β that is greater than α.

6. The power supply device according to claim 1, wherein the step-up circuit is a switching regulator circuit, and the control circuit controls an output voltage of the switching regulator circuit based on the comparison result generated by the comparison circuit to prevent the output voltage from the load from decreasing to below the reference voltage.

7. The power supply device according to claim 1, further comprising:

a load current driving circuit configured to generates an electrical current that flows to the load connected to an output side of the step-up circuit; and a reference electrical current source configured to set a reference electrical current value according to an external signal regardless of changes in the power source voltage and include a reference path through which an electrical current identical with the reference electrical current flows, wherein the reference electrical current source generates the reference voltage on the reference path as a comparison reference of the output voltage of the load.

8. The power supply device according to claim 7, wherein the reference electrical current source further comprises a current mirror circuit in which the reference path is provided, the load current driving circuit includes an electrical current output terminal connected to an output side of the load, and a transistor including a first node connected to a node of the load current driving circuit, a second node connected to a fixed voltage, and a control terminal connected to a terminal that is controlled by the current mirror circuit, and the current mirror circuit forms a current mirror with the reference electrical current source and includes a transistor, on the reference path, that forms a current mirror with the transistor of the load current driving circuit and includes a first node connected to a node at which the reference voltage is generated, a second node connected to a fixed voltage, and a control terminal connected to the control terminal of the transistor of the load current driving circuit.

9. A light-emitting diode (LED) device employing the power supply device of claim 1 in a LED circuit.

10. An electronic device comprising one of the power supply device of claim 1 and a LED device employing the power supply device of claim 1 incorporated in a LED circuit.

* * * * *